US007747358B2

(12) United States Patent
Troost et al.

(10) Patent No.: US 7,747,358 B2
(45) Date of Patent: Jun. 29, 2010

(54) BUILDING EQUIPMENT COMPONENT CONTROL WITH AUTOMATIC FEATURE DETECTION

(75) Inventors: Henry E. Troost, River Falls, WI (US); Brent Chian, Plymouth, MN (US); Timothy J. Nordberg, Plymouth, MN (US); Scott J. Bracken, Long Lake, MN (US)

(73) Assignee: Honeywell International Inc., Morristown, NJ (US)

( * ) Notice: Subject to any disclaimer, the term of this patent is extended or adjusted under 35 U.S.C. 154(b) by 1081 days.

(21) Appl. No.: 11/306,875

(22) Filed: Jan. 13, 2006

(65) Prior Publication Data

US 2007/0177857 A1 Aug. 2, 2007

(51) Int. Cl.
*G05D 23/00* (2006.01)

(52) U.S. Cl. ..... 700/300

(58) Field of Classification Search ..... 700/275, 700/276, 277, 278, 279, 300; 62/178; 122/14.2
See application file for complete search history.

(56) References Cited

U.S. PATENT DOCUMENTS

| | | | |
|---|---|---|---|
| 3,847,350 | A | 11/1974 | Thompson |
| 3,849,350 | A | 11/1974 | Matsko |
| 4,204,833 | A | 5/1980 | Kmetz et al. |
| 4,256,257 | A | 3/1981 | Pinkerton |
| 4,267,965 | A | 5/1981 | Everett |
| 4,299,554 | A | 11/1981 | Williams |
| 4,324,944 | A | 4/1982 | Weihrich et al. |
| RE30,936 | E | 5/1982 | Kmetz et al. |
| 4,333,002 | A | 6/1982 | Kozak |
| 4,460,329 | A | 7/1984 | Trent |
| 4,508,261 | A | 4/1985 | Blank |
| 4,511,790 | A | 4/1985 | Kozak |
| 4,538,980 | A | 9/1985 | Hoyme |
| 4,588,875 | A | 5/1986 | Kozak et al. |
| 4,660,329 | A | 4/1987 | Hutchins |
| 4,692,598 | A | 9/1987 | Yoshida et al. |
| 4,696,639 | A | 9/1987 | Bohan, Jr. |

(Continued)

FOREIGN PATENT DOCUMENTS

| | | |
|---|---|---|
| EP | 0356609 | 3/2006 |

(Continued)

OTHER PUBLICATIONS

MOOG M3000 Control System RTEMP 8 Remote 8-Chnnel Temperature Controller with CANopen Interface; Dec. 13, 2004; pp. 1-6.*

(Continued)

*Primary Examiner*—Albert DeCady
*Assistant Examiner*—Chad Rapp
(74) *Attorney, Agent, or Firm*—Crompton Seager & Tufte LLC

(57) ABSTRACT

A method of accommodating an element in a building equipment component. The presence of the element may be detected, and whether the element is required may be determined. The building equipment component may be operated if the element is present and required, or if the element not required. If the element is absent but required, the building equipment component may be stopped. In some instances, the building equipment component may include a required first sensor, and the element may be an optional second sensor.

25 Claims, 9 Drawing Sheets

U.S. PATENT DOCUMENTS

| | | | |
|---|---|---|---|
| 4,734,658 | A | 3/1988 | Bohan, Jr. |
| 4,742,210 | A | 5/1988 | Tsuchiyama et al. |
| 4,752,210 | A | 6/1988 | Trent |
| 4,770,629 | A | 9/1988 | Bohan, Jr. |
| 4,834,284 | A | 5/1989 | Vandermeyden |
| 4,835,670 | A | 5/1989 | Adams et al. |
| 4,880,376 | A | 11/1989 | Bartels et al. |
| 4,984,981 | A | 1/1991 | Pottebaum |
| 4,986,468 | A | 1/1991 | Deisinger |
| 5,007,156 | A | 4/1991 | Hurtgen |
| 5,039,006 | A | 8/1991 | Habegger |
| 5,276,630 | A | 1/1994 | Baldwin et al. |
| 5,442,157 | A | 8/1995 | Jackson |
| 5,622,200 | A | 4/1997 | Schulze |
| 5,660,328 | A | 8/1997 | Momber |
| 5,797,358 | A | 8/1998 | Brandt et al. |
| 5,896,089 | A | 4/1999 | Bowles |
| 5,968,393 | A | 10/1999 | Demaline |
| 5,975,884 | A | 11/1999 | Dugger |
| 6,048,193 | A | 4/2000 | Juntunen et al. |
| 6,053,130 | A | 4/2000 | Shellenberger |
| 6,059,195 | A | 5/2000 | Adams et al. |
| 6,208,806 | B1 | 3/2001 | Langford |
| 6,261,087 | B1 | 7/2001 | Bird et al. |
| 6,271,505 | B1 | 8/2001 | Henderson |
| 6,293,471 | B1 | 9/2001 | Stettin et al. |
| 6,350,967 | B1 | 2/2002 | Scott |
| RE37,745 | E | 6/2002 | Brandt et al. |
| 6,560,409 | B2 | 5/2003 | Troost, IV |
| 6,701,874 | B1 | 3/2004 | Schultz et al. |
| 6,955,301 | B2 | 10/2005 | Munsterhuis et al. |
| 6,959,876 | B2 | 11/2005 | Chian et al. |
| 7,205,892 | B2 * | 4/2007 | Luebke et al. ..... 340/539.26 |
| 7,221,862 | B1 * | 5/2007 | Miller et al. ..... 392/498 |
| 7,275,533 | B2 | 10/2007 | Soeholm et al. |
| 2001/0025349 | A1 | 9/2001 | Sharood et al. |
| 2001/0031138 | A1 | 10/2001 | Troost, IV |
| 2002/0132202 | A1 * | 9/2002 | Clifford ..... 431/264 |
| 2004/0176859 | A1 | 9/2004 | Chian et al. |
| 2005/0077368 | A1 * | 4/2005 | Zak et al. ..... 237/19 |
| 2005/0161516 | A1 | 7/2005 | Munsterhuis |
| 2006/0214015 | A1 | 9/2006 | Furukawa et al. |
| 2007/0023333 | A1 * | 2/2007 | Mouhebaty et al. ..... 210/91 |

FOREIGN PATENT DOCUMENTS

| | | |
|---|---|---|
| GB | 2211331 | 6/1989 |

OTHER PUBLICATIONS

Lennox, "Network Control Panel (NCP), User's Manual," 18 pages, Nov. 1999.

U.S. Appl. No. 10/911,151, filed Aug. 3, 2004.

Honeywell D896 Automatic Vent Damper, Product Data, 12 pages, 1997.

Honeywell S8610U Universal Intermittent Pilot Module, Installation Instructions, 20 pages, Aug. 1996.

Johnson Controls Q135 Automatic Flue Damper System, 8 pages, 1998.

Weil-McLain, Technical Services Bulletin No. SB201, 2 pages, Nov. 20, 2002.

* cited by examiner

BUILDING EQUIPMENT COMPONENT CONTROL WITH AUTOMATIC FEATURE DETECTION

TECHNICAL FIELD

The present invention relates generally to building equipment components, and more particularly to building equipment component controllers with automatic equipment detection and control.

BACKGROUND

Commercial and residential buildings employ a variety of different building equipment components. Examples of typical building equipment components include heating and cooling equipment such as furnaces, boilers, heat pumps and the like. Other examples of typical building equipment components include water heaters, air exchangers and other ventilation equipment and similar equipment. A variety of HVAC equipment employ dampers, zone valves and the like.

In particular, water heaters are used in homes, businesses and just about any establishment having the need for heated water. Water heaters often heat water using the simple "heat rises" principle. In operation, water heaters typically heat cold or ambient temperature water entering at or near the bottom of the water heater to a desired temperature using a gas-fired burner, an electric heater or some other heater element. During a heating cycle, the cold or ambient temperature water at or near the bottom of the water heater becomes hotter and begins to rise towards the top of the water heater. Cooler and denser water, once on top of the water being heated, falls toward the bottom of the water heater so that it can be heated or reheated to the desired temperature. After the temperature of the water at the bottom of the water heater reaches a certain desired temperature, the water heater typically stops heating the water for a period of time.

When demand for hot water arises (e.g., someone turns on a faucet to run a shower), fresh, cold or ambient temperature water enters the water heater and "pushes out" or supplies the hotter water at or near the top of the water heater. When a sufficient amount of the hotter water exits from the top of the water heater so that the fresh, cold or ambient temperature water entering the bottom causes the temperature of the water at the bottom of the tank to drop below a set point temperature, the water heater typically turns on and repeats the heat cycling described above.

A conventional water heater typically has at least one heating element or "heater," such as a gas-fired and/or electric burner. To take advantage of the "heat-rises" principle, the heater is typically located at or near the bottom of the water heater tank. Each water heater typically also has at least one thermostat or controller for controlling the heater.

To facilitate the heating of water, the controller often receives signals related to the temperature of the water. When these signals indicate that the water temperature is below a first set point, for example, when the water temperature is below 120 degrees Fahrenheit, the controller turns on the heater and the water at or near the bottom of the water heater begins to heat. After some time, the temperature of the water at the bottom of the water heater will increase to a second set point, which, for example, may be about 140 degrees Fahrenheit. When the water temperature at the bottom of the tank is indicated as being greater than the second set point, the controller typically causes the heater to reduce its heat output or, alternatively, causes the heater to turn off. The heat cycle begins again when the temperature of the water at the bottom of the water heater drops below the first set point.

Some water heaters rely upon a single water temperature sensor, while others employ two water temperature sensors. In some cases, using two water temperature sensors, such as one at or near the top of a water heater and a second at or near the bottom of a water heater, may provide improved temperature control resulting in energy savings, higher hot water capacity, and greater potential safety.

As described above, the hottest water in a water heater may typically be found at or near the top of the water heater tank. As a result, the water at or near the top of the water heater tank may be substantially hotter than the water at or near the bottom of the water heater tank, such as where a single water temperature sensor may be located. This means that the water at or near the top of the water heater tank may be hotter or even substantially hotter than a lower, safer temperature, such as may be indicated by the water temperature sensor at or near the bottom of the water heater tank.

Thus, in some cases a water heater includes a second temperature sensor that may be positioned at or near the top of the water heater tank, in order to provide the controller with information pertaining to the water temperature at or near the top of the water heater tank. The second temperature sensor positioned at or near the top of the water heater tank may also be useful in reducing or eliminating stratification, which may occur as a result of frequent small hot water withdrawals from the water heater tank.

SUMMARY

The present invention relates generally to building equipment components, and more particularly to building equipment component controllers with automatic equipment detection and control.

Accordingly, an example embodiment of the present invention may be found in a method of operating building equipment, the building equipment component including an element. The presence of the element may be detected. In some instances, whether or not the element is required for proper operation may be determined, although this is not required. In some cases, the building equipment component may be operated if the element is present and required, or if the element is not required. If the element is required but absent, the building equipment component may be stopped. In some instances, the building equipment component may include a required first sensor, and the element may be an optional second sensor.

In some instances, the element may be determined to be required if the element is detected at least once. The building equipment component may have an operational cycle, and determining if the element is present may occur during each operational cycle. In some cases, the building equipment component may be a water heater, and determining if the element is present may occur each time the water heater enters a heating period. Operating the building equipment component may, in some cases, include operating a heat source. Conversely, stopping the building equipment component may include stopping the heat source.

Another illustrative but non-limiting example of the present invention may be found in a method of operating a building equipment component that includes a first sensor and a second sensor. A presence of the first sensor may be checked for, and the building equipment component may be disabled if the first sensor is not detected. A presence of the second sensor may be checked for. If the second sensor is required but not detected, the building equipment component may be disabled, if desired. If the second sensor is required and detected, operation of the building equipment component may be enabled.

In some cases, the second sensor may be deemed to be required if the second sensor is detected at least three times. The building equipment component may include a heat source. In some cases, the heat source may be a fuel burner or an electrical heating element.

Another illustrative but non-limiting embodiment of the present invention may be found in a method of operating a water heater that includes a first sensor and may include a second sensor. A presence of the first sensor may be detected. A presence or absence of the second sensor may be detected. The water heater may be operated in a first mode if the first sensor is present and the second sensor is absent. The water heater may be operated in a second mode if the first sensor and the second sensor are both present. In some cases, the first mode may be different from the second mode, although this is not required.

In some instances, the water heater may be stopped if the second sensor is subsequently removed after being detected. The water heater may be stopped if the second sensor is removed after a given period of time has elapsed after initial detection of the second sensor. In some cases, the water heater may be stopped if the second sensor has been removed after, for example, a given number of water heater cycles after initial detection of the second sensor.

Operating the water heater in a first mode may, in some instances, include operating the water heater using sensor input from the first sensor. Operating the water heater in a second mode may, in some cases, include operating the water heater using sensor input from the first sensor and from the second sensor. The first sensor may be a first temperature sensor, if desired. The second sensor may be a second temperature sensor. The first water sensor may be positioned at or near the bottom of the water heater and the second sensor may be positioned at or near the top of the water heater.

Another illustrative but non-limiting embodiment of the present invention may be found in a controller that is adapted to control a building equipment component that optionally includes an element. The controller may be adapted to detect if the element is attached or absent. The controller may operate the building equipment component in a first operating mode when the element is attached and in a second operating mode when the element is absent.

In some instances, the building equipment component may be a water heater. In some cases, the water heater may include a first water temperature sensor, and the element may be a second water temperature sensor. The controller may include a first sensor input that may be connected to the first water temperature sensor, a second sensor input that may be connected to the second water temperature sensor, and a microcontroller adapted to recognize signals received by the first sensor input and the second sensor input.

Another illustrative but non-limiting embodiment of the present invention may be found in a controller that is adapted to control a building equipment component, the building equipment component optionally including an element. In some cases, the building equipment component may be a water heater, and the water heater may include a first water temperature sensor and the element may include a second water temperature sensor.

The controller may be adapted to detect whether the element is attached or absent, and thus provide a detected element status. The controller may be adapted to remember if the element is attached or absent, and thus provide a stored element status. Operation of the appliance may be allowed only when the detected or current element status matches the stored element status.

Another illustrative but non-limiting embodiment of the present invention may be found in a water heater. The water heater includes a water tank, a first water temperature sensor that is positioned near a bottom of the tank, and a second water temperature sensor that is positioned near a top of the tank.

The water heater may include a heating element, and a controller that is adapted to control the heating element. The controller may include a first sensor input and a second sensor input. In some instances, the controller permits operation of the heating element when the first sensor input detects the first water temperature sensor and the second sensor input detects the second water temperature sensor. The controller may not permit operation of the heating element if the first and/or the second sensor input does not detect the first and/or second water temperature sensors.

The above summary of the present invention is not intended to describe each disclosed embodiment or every implementation of the present invention. The Figures, Detailed Description and Examples which follow more particularly exemplify these embodiments.

DETAILED DESCRIPTION OF THE FIGURES

The invention may be more completely understood in consideration of the following detailed description of various embodiments of the invention in connection with the accompanying drawings, in which.

Figure 1:
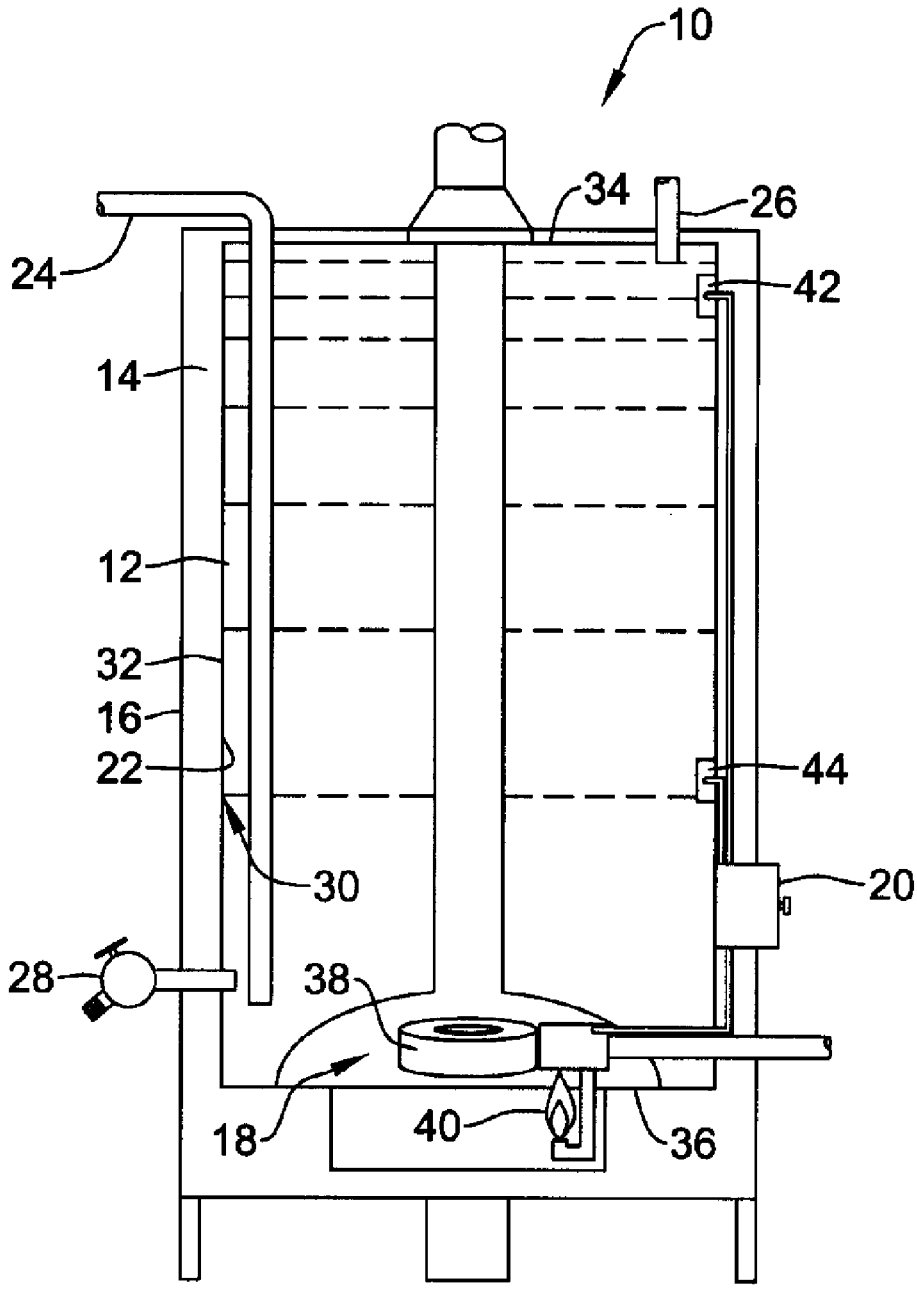
FIG. 1 is a schematic illustration of an exemplary water heater in accordance with an embodiment of the present invention.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION

The following description should be read with reference to the drawings, in which like elements in different drawings are numbered in like fashion. The drawings, which are not necessarily to scale, depict selected embodiments and are not intended to limit the scope of the invention. Although examples of construction, dimensions, and materials are illustrated for the various elements, those skilled in the art will recognize that many of the examples provided have suitable alternatives that may be utilized.

The present invention pertains and is relevant to a variety of building equipment components. Examples of building equipment components include furnaces, boilers, heat pumps, water heaters, air exchangers, dampers and other ventilation equipment and similar equipment. Merely for illustrative purposes, and not to be intended as limiting in any manner, the present invention will be discussed with respect to a water heater.

FIG. 1 is cutaway view of an illustrative water heater 10. The water heater 10 includes a tank 12, an insulating layer 14, an external shell 16, a heater 18, and a controller 20. Tank 12 holds water that is to be heated and, in the illustrated embodiment, is constructed of steel or other heat conducting material. Tank 12 has an inner surface 22, an input supply tube or dip tube 24, an output conduit or pipe 26, a drainage valve 28, a rust inhibiting liner 30, and an outer surface 32.

Insulating layer 14 may be located between outer surface 32 of tank 12 and external shell 16. Insulating layer 14 limits or otherwise minimizes the heat loss of the heated water from passing from tank 12 to the outside world. Bonded to the inside of inner surface 22 is rust inhibiting liner 30. In addition, tank 12 may have a sacrificial anode rod (not illustrated) to keep tank 12 from corroding.

Tank 12 also has a top surface 34 and a bottom surface 36. In the illustrated embodiment, dip tube 24 and output pipe 26 pass through top surface 34. Output pipe 26 extends through top surface 34 to a second predetermined distance from bottom surface 36. This second predetermined distance may be fairly close to top surface 34. Positioning output pipe 26 close to top surface 34 allows the hotter water, which may be the hottest water in tank 12, to exit upon demand. In operation, when the hot water is demanded, fresh water flows into dip tube 24 at or near the bottom of tank 12 and pushes or otherwise causes the hotter water at the top of tank 12 to exit through output pipe 26.

Like output pipe 26, dip tube 24 extends through top surface 34 to a predetermined distance from bottom surface 36. This predetermined distance may be fairly close to bottom surface 36. Positioning the exit of dip tube 24 close to bottom surface 36 allows the fresh, cold or ambient water to enter tank 12 near bottom surface 36. This may help the cold or ambient water from not mixing and cooling the hotter water near top surface 34. In some cases, dip tube 24 may be located about three quarters of the distance from top surface 34 to bottom surface 36. Because the cooler water entering tank 12 is denser than hotter water, the cooler water tends to sink to the bottom of tank 12, where it may be heated by heater 18.

Heater 18 heats tank 12, which in turn heats any water inside tank 12. Heater 18 may be a gas-fired heater, an electric heater, a plurality of gas-fired burners, a plurality of electric heaters, a combination of gas-fired and electric heaters or any other heat source, as desired. When called upon, heater 18 may provide a small amount of heat, a large amount of heat, or no heat at all.

In the exemplary gas-fired water heater 10 shown in FIG. 1, heater 18 may have a gas-flow valve (not shown), a burner 38 and an ignition source 40. The gas-flow valve may be a solenoid-controlled valve, a linear actuated valve, a motor actuated valve, or any other valve capable of supplying and/or regulating gas flow to burner 38. Ignition source 40 may be a pilot light, a solid-state igniter, an electric heat element, or any other ignition source capable of igniting the gas.

The heat output of heater 18 may be controlled by burner orifice size, gas pressure, and/or time. To produce heat in the gas-fired water heater, gas flows into burner 38 through the gas-flow valve, where ignition source 40 ignites the gas. The gas will continue to burn until the supply of gas is terminated.

In an alternative water heater embodiment (not shown), the heat output may be controlled by an electric current flow through a resistive heating element. To produce heat in an electric heater, the amount of current provided through the resistive heating element is regulated. In regulating the heat output, the more current impressed on the electric heating element, the more heat is produced. Conversely, less or no heat is produced if the current is reduced or turned off, respectively.

The illustrative water heater 10 includes an upper sensor 42 and a lower sensor 44. Upper sensor 42 may be a temperature sensor or another device capable of sensing a measure of water temperature at or near the top of tank 12. While upper sensor 42 may be located towards top surface 34 near the exit opening in the output pipe 26, the sensor need not be physically located at the top of water heater 10, provided that the temperature of the water at or near the top is detected by the sensor. In some illustrative embodiments, upper sensor 42 may be located from about 4 to about 8 inches from top surface 124.

Like upper sensor 42, lower sensor 44 may be a temperature sensor, or another device capable of sensing a measure of water temperature at or near the bottom of tank 12. In an exemplary embodiment, lower sensor 44 may be located towards bottom surface 36 and towards the exit of dip tube 24. The lower sensor 44, however, need not be located in such position, provided that lower sensor 44 is able to sense the water temperature at or near the bottom of tank 12.

As will be discussed in greater detail with respect to subsequent Figures, upper sensor 42 and lower sensor 44 may provide signals representing detected water temperature values to controller 20. In some instances, upper sensor 42 and lower sensor 44 may each incorporate switches and/or logic modules so as to be able to provide controller 20 with switched signals relating to the detected water temperature values.

It is contemplated, for example, that in response to upper sensor 42 detecting a hot water temperature that is over a given threshold, one or more of such logic modules may cause one of the switches to open or close, thereby signaling controller 20 that the hot water temperature is over the given threshold. Further, the logic modules may keep the switch in that position so long as the detected temperature is over the given threshold, or a different threshold, and in some cases may provide some level of hysteresis.

It will be recognized that controller 20 may receive signals from upper sensor 42 and lower sensor 44, and may, in response to these signals, produce an output to initiate, maintain and/or terminate a heating cycle. During a heating cycle, controller 20 may, for example, regulate gas flow to burner 38. When gas is supplied to burner 38, controller 20 may instruct or trigger ignition source 40 to ignite the gas, if ignition source 40 requires such trigger. Burner 38 then burns the gas until the demand for heat ceases.

Once the heat demand ceases, controller 20 may shut off the gas supply, thereby extinguishing burner 38. For some cases, controller 20 may modulate the flow of gas to burner 38 to thereby modulate the heat output of burner 38. If water heater 10 is instead electrically heated, it will be recognized that controller 20 may control the heating cycle of the one or more electrical heating elements.

Figure 2:
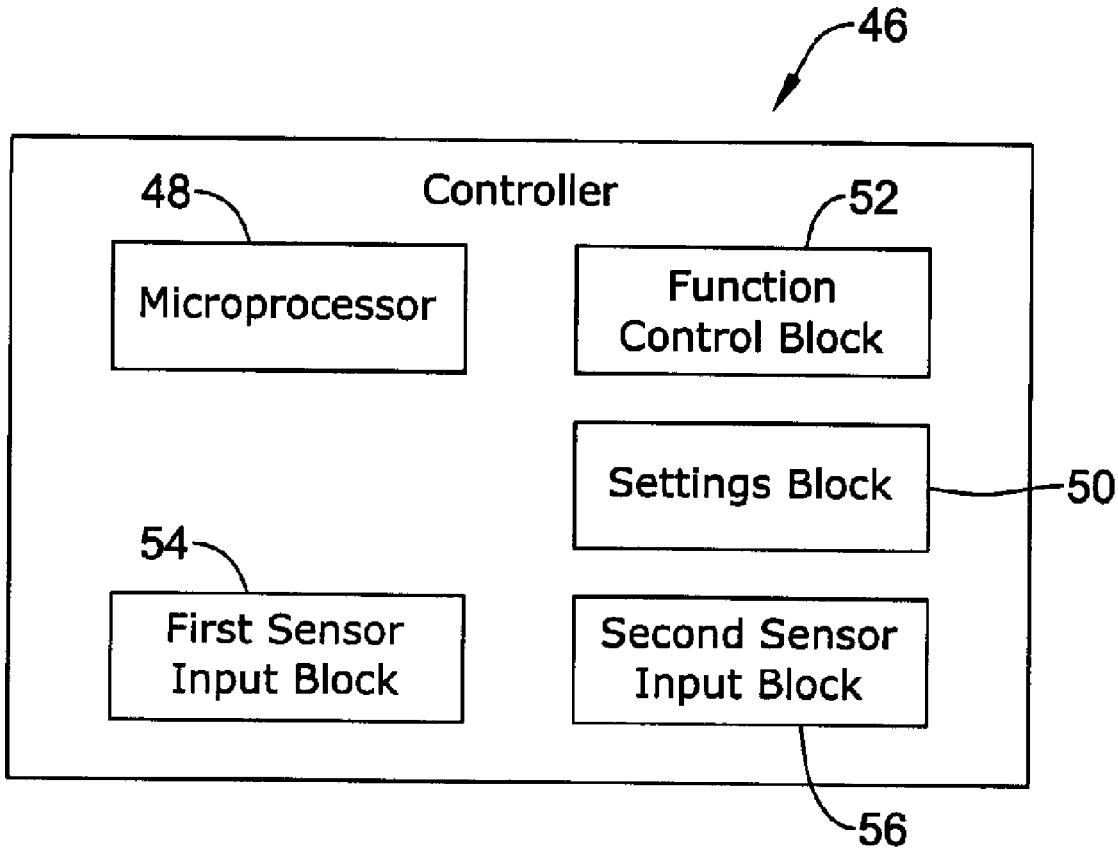
FIG. 2 is a schematic illustration of an exemplary building equipment component controller in accordance with an embodiment of the present invention.

FIG. 2 shows an illustrative but non-limiting controller 46 that may be employed in controlling and/or operating a variety of different building equipment. Examples of building equipment components that may be controller and/or operated by controller 46 include forced air furnaces, boilers for hot water and/or steam heating systems, heat pumps, ventilation systems, dampers, thermostats and the like. In some instances, controller 46 may be used to control and/or operate a water heater.

Controller 46 includes a microprocessor 48 that, as will be recognized, actually processes inputs in order to provide appropriate control commands for the particular equipment that building equipment controller 46 is controlling and/or operating. While not expressly shown, microprocessor 48 may include memory (sometimes non-volatile memory) to store programming, parameter values, flags and/or the like.

The illustrative controller 46 also includes a settings block 50 that may permit a user to input various parameters. Settings block 50 may be in communication with a control knob, a keypad or any other input devices, depending on the application. If, for example, controller 46 is being used with a water heater 10 (FIG. 1), settings block 50 may accept a user-defined temperature set point from a control knob.

A function control block 52 may also be provided, The illustrative function control block 52 may accept commands from microprocessor 48, and translate these commands into appropriate signals for controlling a function of whatever building equipment component controller 46 is being used with. In the example given above, in which controller 46 is being used to control a water heater 10 (FIG. 1), function control block 52 may control heater 18 (FIG. 1). In some cases, function control block 52 may also receive signals from the function being controlled, such as confirmation of command receipt, and the like.

Illustrative controller 46 also includes a first sensor input block 54 and a second sensor input block 56. With reference to the water heater example above, first sensor input block 54 may be in communication with upper sensor 42 (FIG. 1) while second sensor input block 56 may be in communication with lower sensor 44. Alternatively, these may be reversed, as first and second are arbitrary references. In some instances, the lower sensor 44 may be in communication with one of the first sensor input block 54 and the second sensor input block 56, and the upper sensor 42 may be absent.

As will be discussed in greater detail hereinafter, controller 46 may be adapted to determine if first sensor input block 54 is in fact in communication with a first sensor and/or to determine if second sensor input block 56 is in fact in communication with a second sensor. Controller 46 may make these determinations in a variety of manners. In some instances, controller 46 may detect, for example, whether a connector or plug has been physically inserted into an adaptor, port, receptor, or the like.

In some cases, a first sensor and/or a second sensor may provide an electrical signal that is proportional to or at least representative of a parameter value that is of interest to controller 46. For example, if a resistance is detected, a sensor is deemed to be connected. If first sensor input block 54 receives a valid electrical signal, then a first sensor may be determined to be present. Similarly, if second sensor input block 56 receives a valid electrical signal, then a second sensor may be determined to be present. In some instances, an electrical signal may be deemed to be a valid electrical signal if it is within a predetermined range. If an electrical signal is outside a predetermined range, this may indicate sensor failure or some other difficulty. The predetermined range for any particular sensor may easily be determined.

Figure 3:
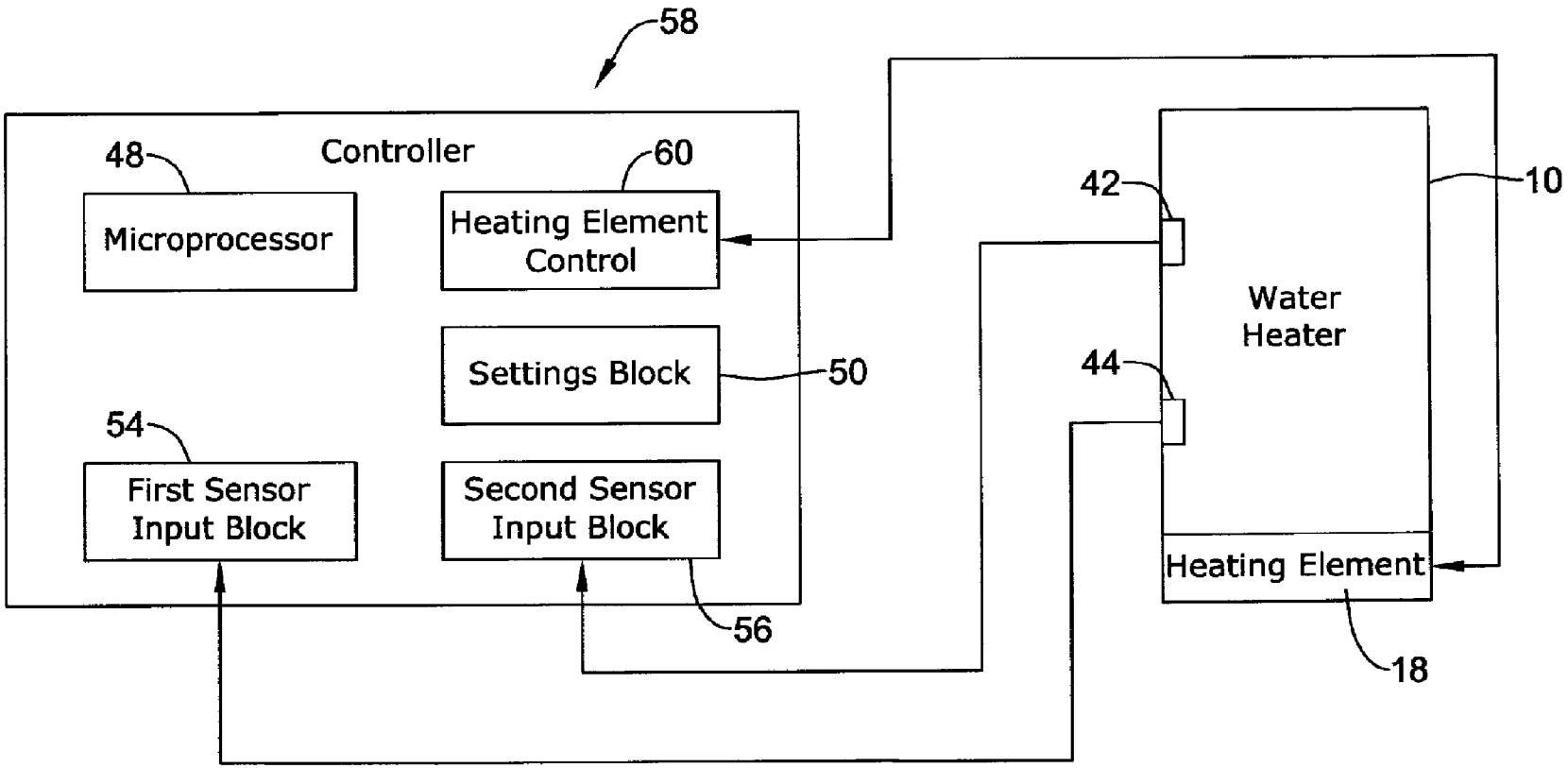
FIG. 3 is a schematic illustration of an exemplary water heater in accordance with an embodiment of the present invention.

In FIG. 3, a controller 58 is shown in communication with elements of water heater 10 (FIG. 1). Controller 58 is similar to controller 46 (FIG. 2), except that function control block 52 (FIG. 2) is now expressed as a heating element control block 60. Heating element control block 60 accepts commands from microprocessor 48, and translates these commands into appropriate signals for controlling heater 18. In some cases, heating element control block 52 may also receive confirmation signals and the like from heater 18, but this is not required.

In some instances, controller 58 may function, as shown in FIG. 3, in communication with a water heater 10 having both an upper sensor 42 (FIG. 1) and a lower sensor 44. In this situation, upper sensor 42 may be in electrical communication with, for example, first sensor input block 54 and lower sensor 44 may be in electrical communication with second sensor input block 56. In some cases, water heater 10 may only have lower sensor 44, and upper sensor 42 may be omitted. Controller 58 may be adapted to work with either a single sensor input, or two sensor inputs.

Figure 4:
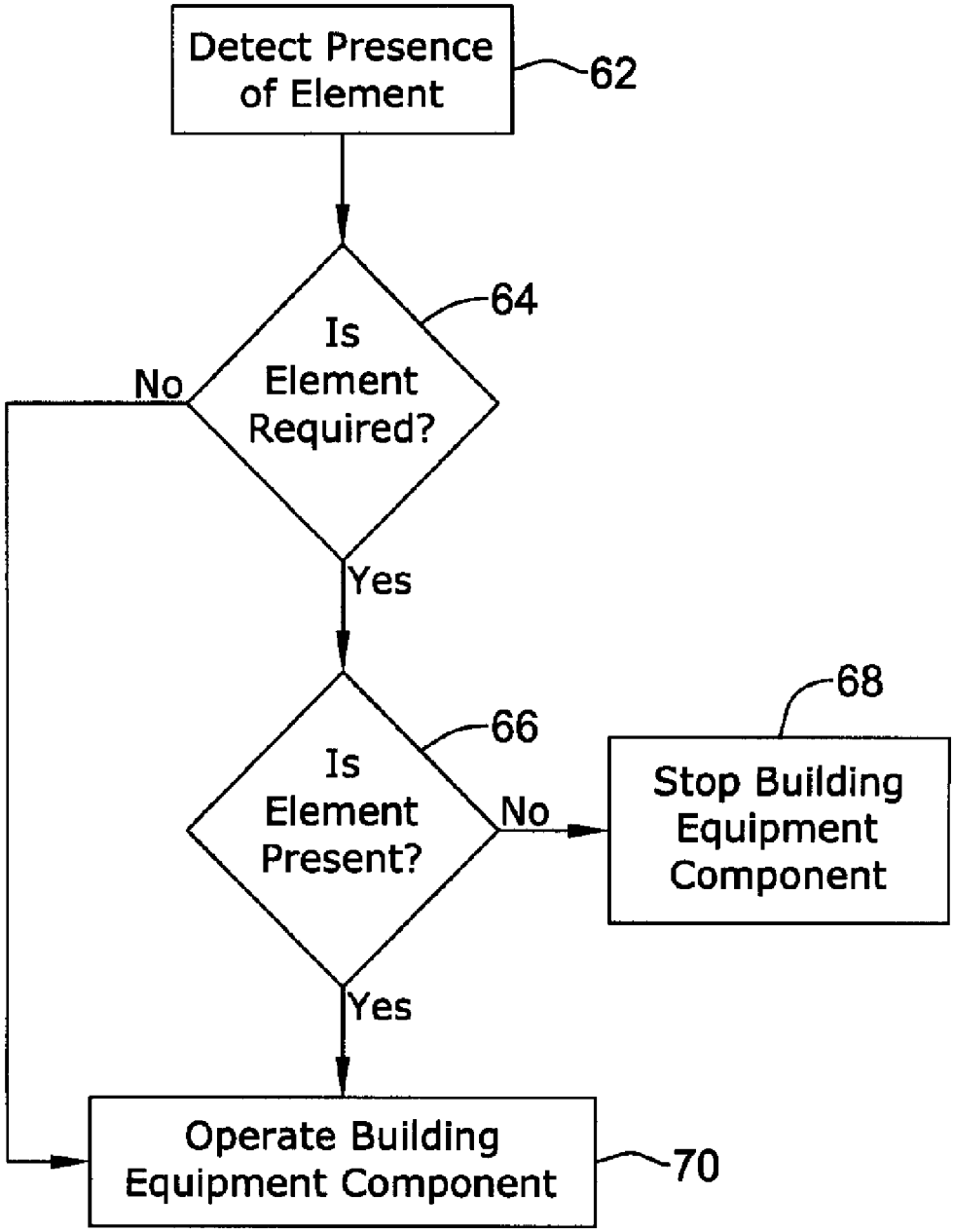
FIG. 4 is a flow diagram illustrating an exemplary method that may be carried out by the building equipment component controller of FIG. 2.

FIG. 4 is a flow diagram illustrating an exemplary method that may be carried out by the illustrative controller 46 (FIG. 2). At block 62, the presence of an element is detected. An element may be any portion of a building equipment component, a device within a building equipment component, or the like. In some instances, an element may be a sensor, a damper, an electric ignition, a second stage of a furnace burner, a second stage of a heat pump, and the like. In some cases, such as the water heater example above, an element may be a temperature sensor.

In some instances, the presence or absence of an element may be determined by checking to see if the element in question is physically connected, or is returning a valid electrical signal to controller 46. If a valid electrical signal is present, the element may be deemed to be present. If no valid electrical signal or other sign of presence is detected by controller 46, then the element may be deemed to be absent.

At decision block 64, controller 46 (FIG. 2) determines whether or not the element is required. If the element is not required, such as might be the case if the element is optional and is not an important operational or safety element, control passes to block 70, at which point controller 46 permits operation of whatever building equipment component is being controlled.

If, however, the element is required, such as might be the case if the element is an important operational or safety element, or is needed to achieve an operational guideline or to pass a safety test, control passes to decision block 66. In some cases, the element may be deemed to be required as soon as it has been detected at least once. In some instances, the element is deemed to be required once it has been detected a predetermined number of times, or over a particular length of time.

At decision block 66, controller 46 (FIG. 2) determines if the element is present or not. As noted, this may be determined by whether or not the element is returning an electrical signal to controller 46. If the element is not present, control passes to block 68 at which point controller 46 stops operation of the building equipment component. If the element is present, however, control passes to block 70, at which point controller 46 permits operation of the building equipment component that controller 46 is controlling.

In some cases, if the building equipment component being controlled by controller 46 (FIG. 2) is a water heater 10 (FIG. 1), the presence of a second temperature sensor may be important. All or virtually all water heaters (10) employ a temperature sensor at or near a bottom of a water heater tank 12 (FIG. 1) in order to determine when and/or how heater 18 (FIG. 1) should be operated.

Some water heaters 10 (FIG. 1) also employ a second temperature sensor that may be located at or near a top of a water heater tank 12 (FIG. 1). The second temperature sensor provides information to controller 46 (FIG. 2) regarding water temperature at or near the top of the water heater tank 12. Providing controller 46 with this additional information may provide for more energy efficient usage. Moreover, this additional information may provide for improved capacity as well as safer operation of water heater 10.

Thus, in the water heater example described above, if the element in question at decision block 64 is a second temperature sensor, the element may indeed be important to optimal operation of water heater 10 (FIG. 1), and therefore may be deemed to be required.

Figure 5:
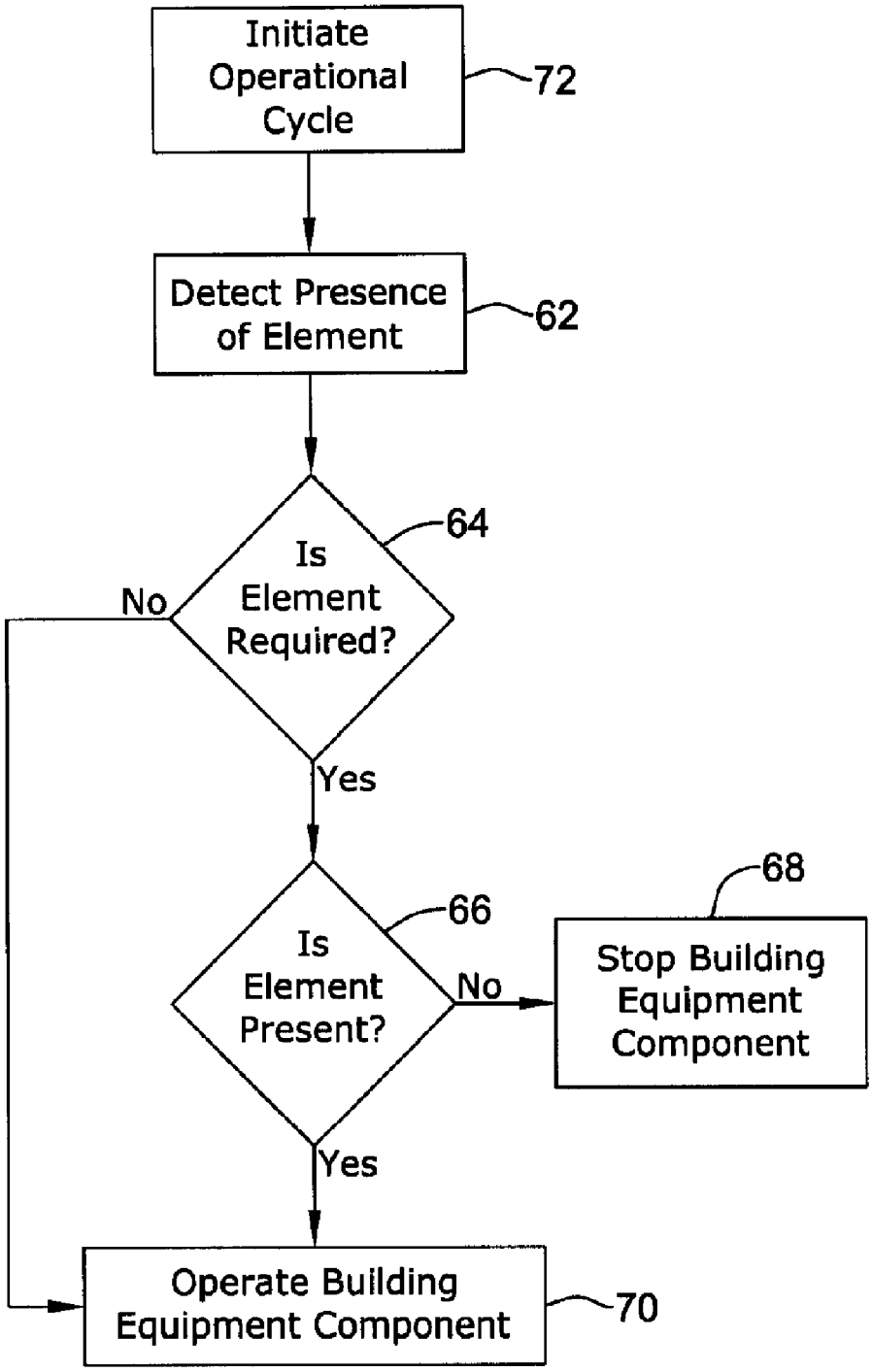
FIG. 5 is a flow diagram illustrating an exemplary method that may be carried out by the building equipment component controller of FIG. 2.

FIG. 5 is similar to FIG. 4, but potentially represents a more continuous process. At block 72, controller 46 (FIG. 2) initiates an operational cycle. If, for example, the building equipment component being controlled is a water heater, an operational cycle may represent a heating cycle. Control passes to block 62, where the presence of an element is detected. At decision block 64, controller 46 (FIG. 2) determines whether or not the element is required. If the element is not required, control passes to block 70, at which point controller 46 permits operation of whatever building equipment component is being controlled.

If, however, the element is required, control passes to decision block 66. At decision block 66, controller 46 (FIG. 2) determines if the element is present or not. If the element is not present, control passes to block 68 at which point controller 46 stops operation of the building equipment component. If the element is present, however, control passes to block 70, at which point controller 46 permits operation of the building equipment component that controller 46 is controlling. From block 70, control reverts to block 72, at which point a new operational cycle may be initiated.

Figure 6:
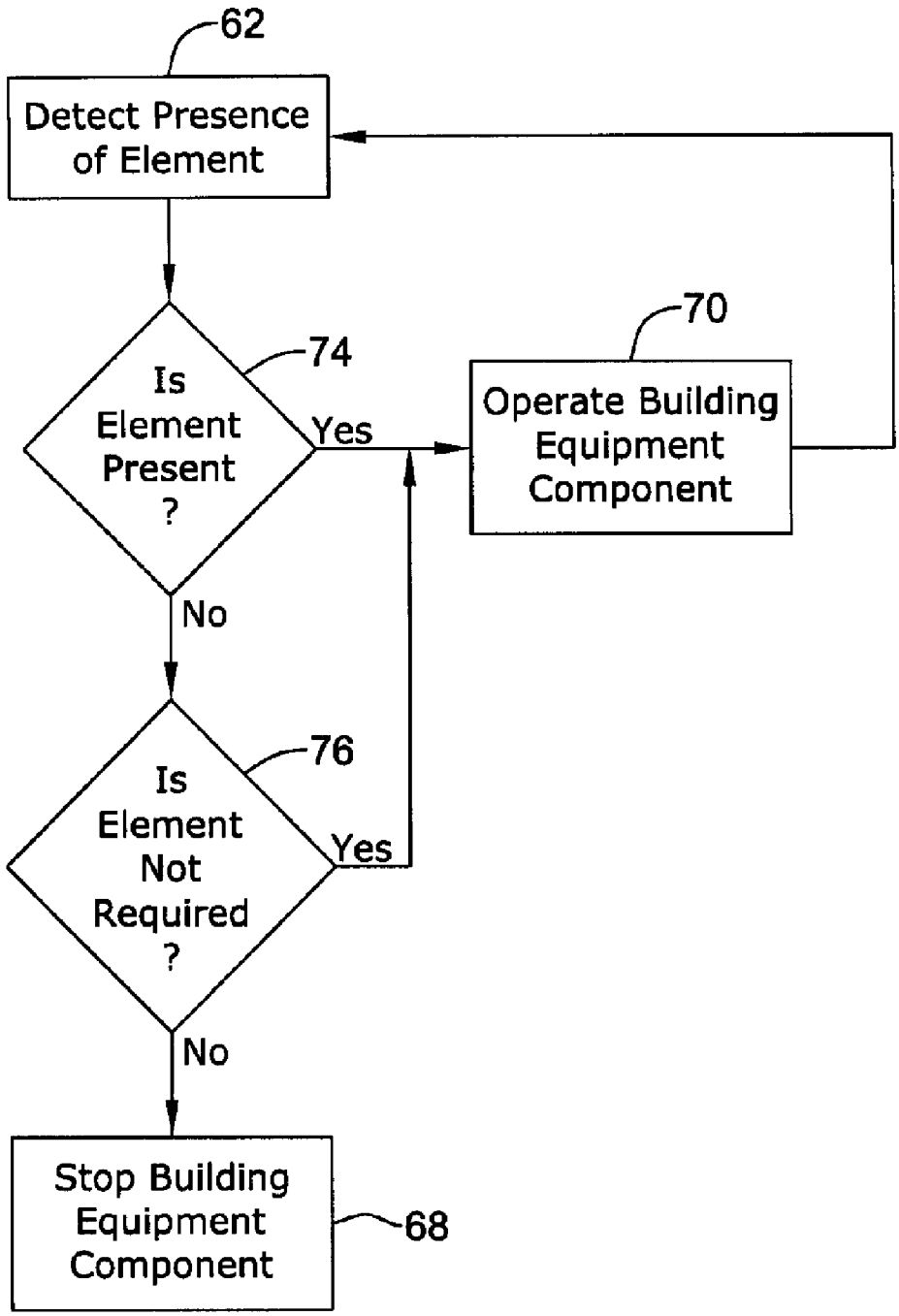
FIG. 6 is a flow diagram illustrating an exemplary method that may be carried out by the building equipment component controller of FIG. 2.

FIG. 6 shows a flow diagram illustrating an exemplary method that may be carried out by the illustrative controller 46 (FIG. 2). At block 62, the presence of an element is detected. Control passes to decision block 74, where controller 46 determines if the element is present. If so, control passes to block 70, where the building equipment component is permitted to operate. If controller 46 determines, however, that the element is not present, control passes to decision block 76.

At decision block 76, controller 46 (FIG. 1) determines if the element is not required. If so, control passes to block 70 and the building equipment component is permitted to operate. If not, control passes to block 68 and the building equipment component is stopped. From block 70, control reverts to block 62, at which point a new operational cycle may be initiated, if desired.

Figure 7:
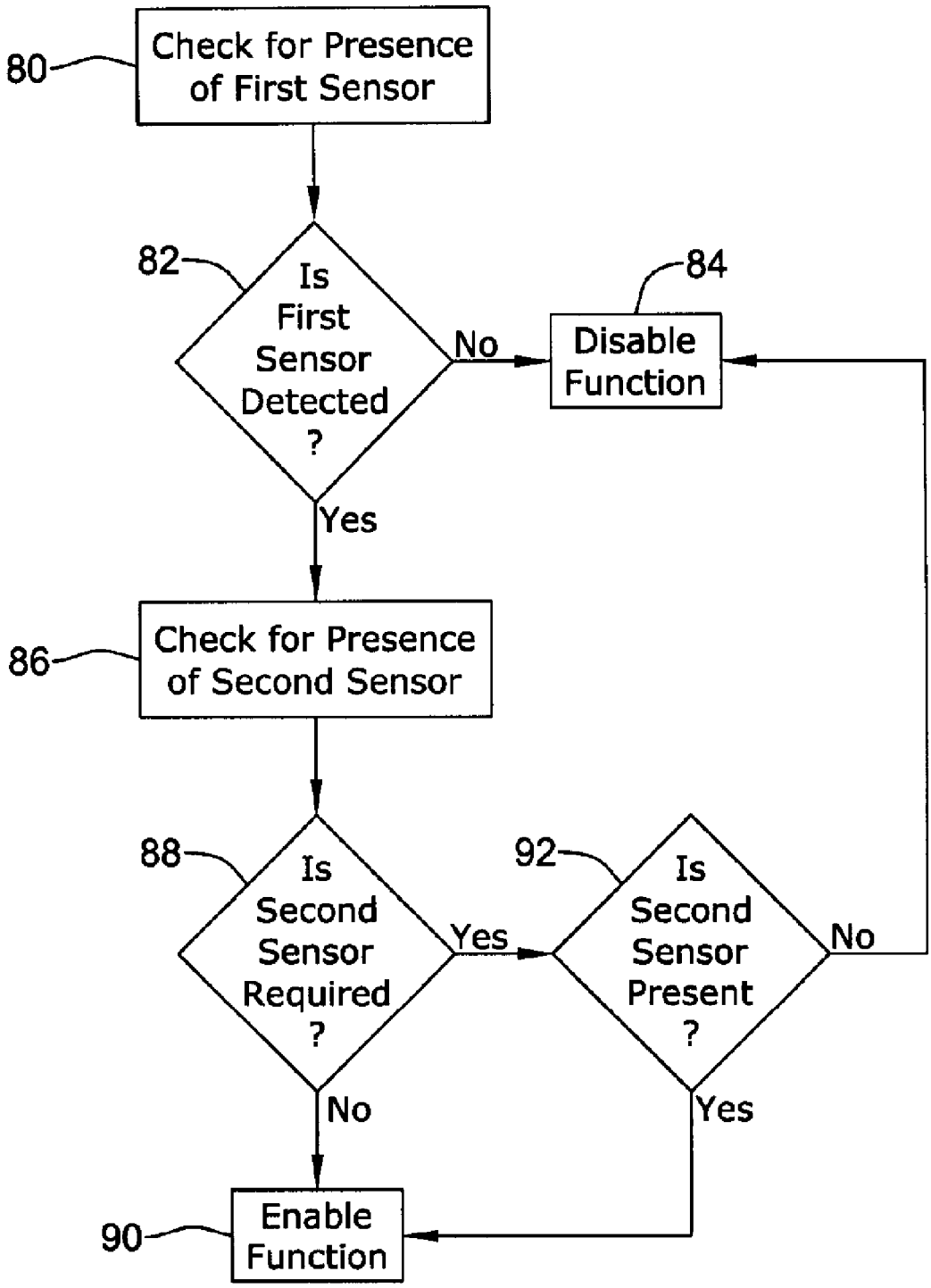
FIG. 7 is a flow diagram illustrating an exemplary method that may be carried out by the building equipment component controller of FIG. 2.

FIG. 7 shows a flow diagram illustrating an exemplary method that may be carried out by controller 46 (FIG. 2). At block 80, controller 46 checks for the presence of a first sensor. As noted previously, the presence of a first sensor may be determined by the presence of an electrical signal at first sensor input 54 (FIG. 2), or some other physical indication.

Control passes to decision block 82, where controller 46 (FIG. 2) determines if a first sensor has been detected. If not, control passes to block 84, where controller 46 disables a function. A function may be any portion or operation of whatever building equipment component is being controlled by controller 46. For example, if the building equipment component is a furnace, the function may be the burner, or operation of the burner.

If, for example, controller 46 is being used to control water heater 10 (FIG. 1), the function may include or represent operation of heater 18 (FIG. 1). If a first sensor is detected, control passes to block 86, where controller 46 checks for the presence of a second sensor. The presence of a second sensor may, in some cases, be indicated by the presence of an electrical signal at second sensor input 56 (FIG. 2).

At decision block 88, controller 46 (FIG. 2) determines if the second sensor is required. In some cases, the second sensor may be deemed to be required as soon as it has been detected at least once. In some instances, the second sensor is deemed to be required once it has been detected a predetermined number of times, or over a particular length of time.

If the second sensor is not required, control passes to block 90, and the function is enabled. However, if the second sensor is required, control passes to decision block 92. At decision block 92, controller 46 determines if the second sensor is present. If the second sensor is present, control passes to block 90 and the function is enabled. Otherwise, control passes to block 84 and the function is disabled.

Figure 8:
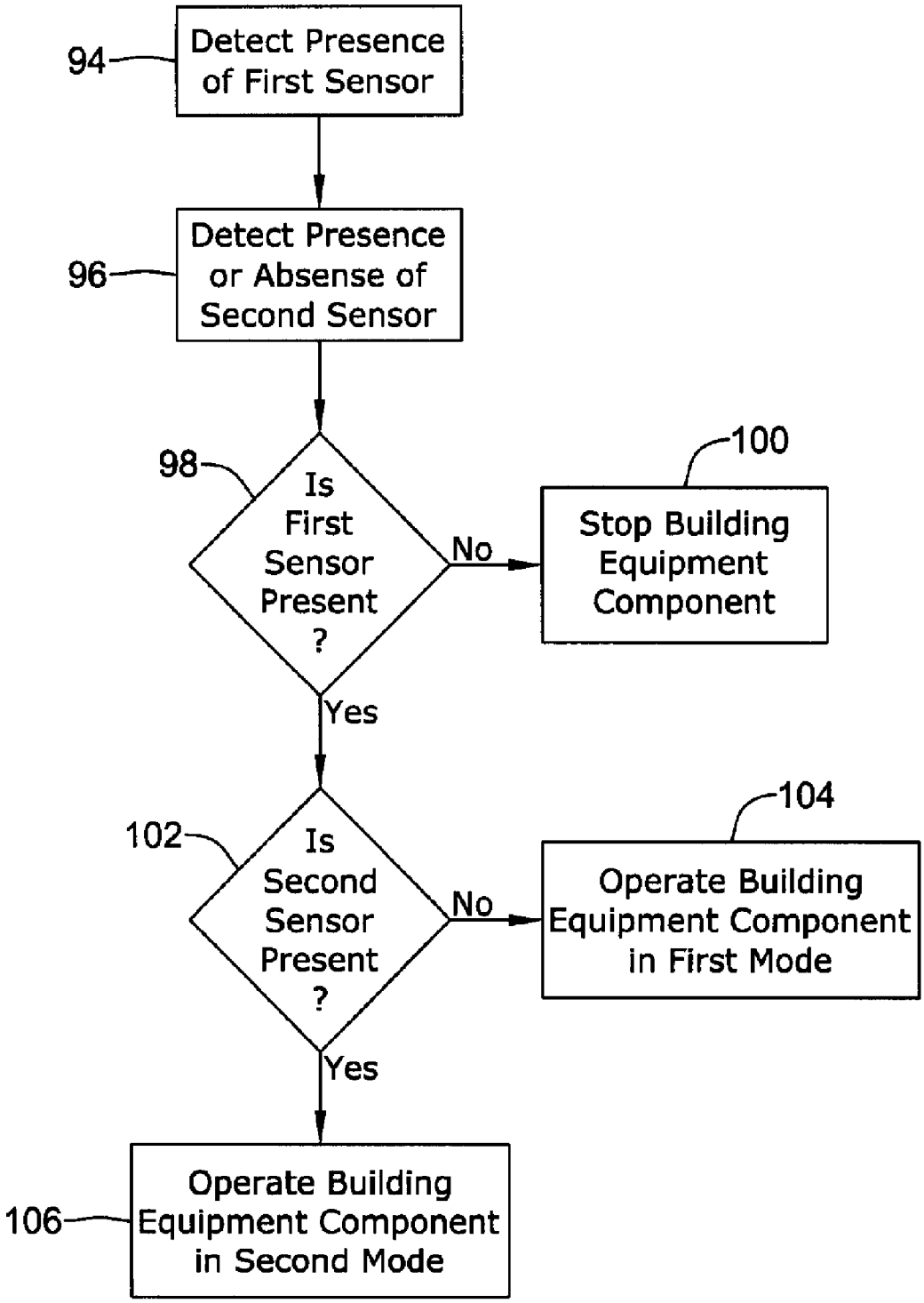
FIG. 8 is a flow diagram illustrating an exemplary method that may be carried out by the building equipment component controller of FIG. 2.

FIG. 8 shows a flow diagram illustrating an exemplary method that may be carried out by controller 46 (FIG. 2). At block 94, controller 46 detects the presence of a first sensor. As discussed with respect to earlier Figures, detecting the presence of the first sensor may include checking to see if a valid electrical signal is being received from the sensor, or perhaps some other physical indication. Control passes to block 96, at which time controller 46 detects the presence or absence of a second sensor.

At decision block 98, controller 46 (FIG. 2) determines whether the first sensor is present, i.e., was detected at block 94. If the first sensor is not present, control passes to block 100 at which point controller 46 stops the building equipment component being controlled by controller 46. If the first sensor is present, control passes to decision block 102, where controller 46 determines whether or not the second sensor is present.

If the second sensor is not present, control passes to block 104, and controller 46 operates the building equipment component in a first mode. If the second sensor is present, control passes to block 106 and controller 46 operates the building equipment component in a second mode. In some cases, operating the building equipment component in a first mode may mean that the building equipment component is operated relying upon sensor input from the first sensor and not from the second sensor. In some cases, operating the building equipment component in a second mode may mean that the building equipment component is operated relying upon sensor input from the first sensor and from the second sensor.

Figure 9:
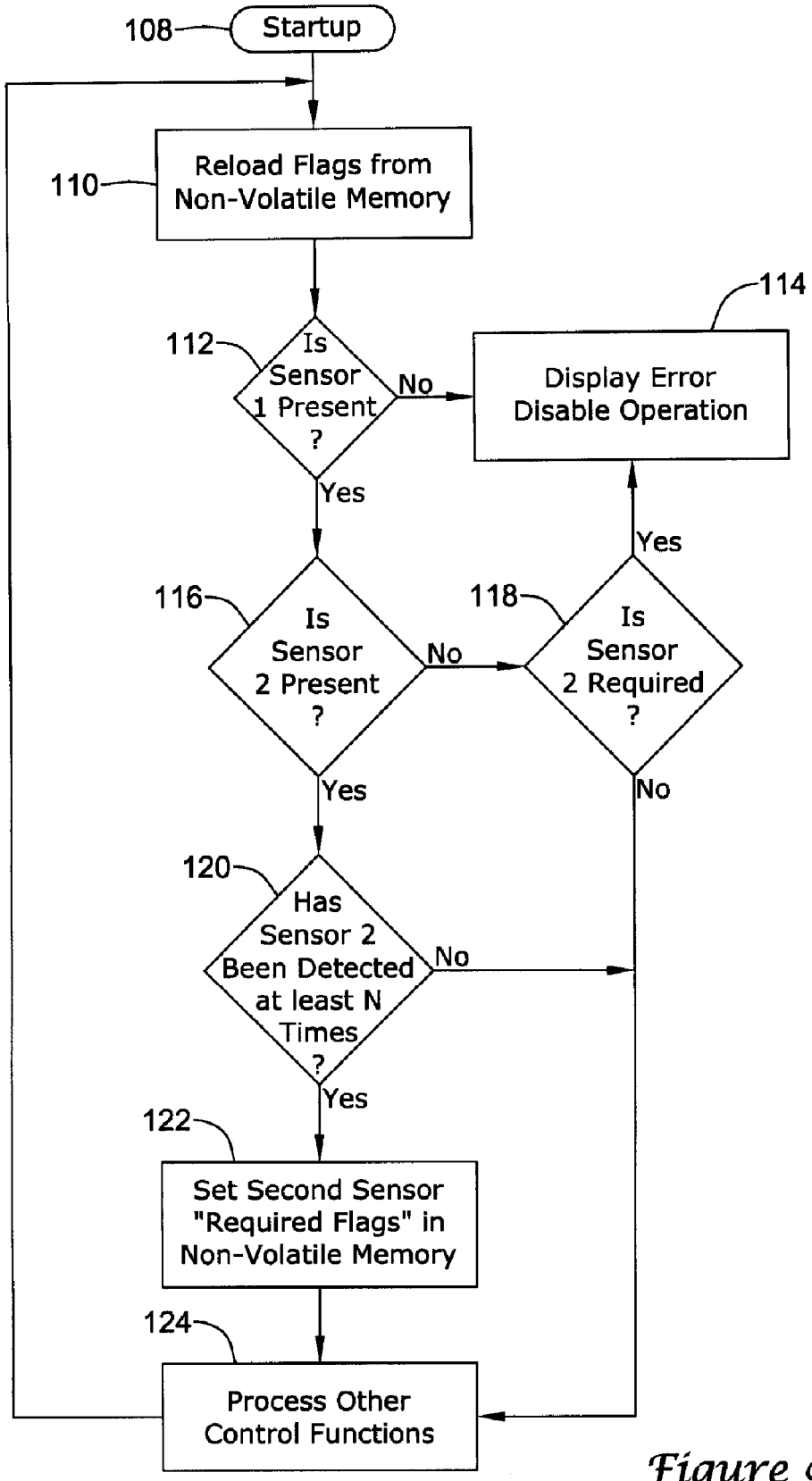
FIG. 9 is a flow diagram illustrating an exemplary method that may be carried out by the building equipment component controller of FIG. 2.

FIG. 9 shows a flow diagram illustrating an exemplary method that may be carried out by controller 46 (FIG. 2). At block 108, a building equipment component undergoes a startup routine. This may involve onboard diagnostics and related tests. In particular, the building equipment component may be a water heater, and the startup routine may include, for example, tests to determine that each of the electrical and electronic components of the water heater are functioning properly.

At block 110, controller 46 (FIG. 2) may reload any flags into memory. The flag or flags, prior to being reloaded, may be stored in non-volatile memory. As will be discussed shortly, one of the flags (if more than one are present) may be used to remember whether a second sensor is required (e.g. has been previously detected) or not. Control passes to decision block 112, where controller 46 determines if the first sensor is present. As discussed, this may be accomplished by checking to see if controller 46 is receiving a valid electrical signal from the first sensor, or any other physical indication.

If the first sensor is not present, control passes to block 114, where controller 46 (FIG. 2) disables burner operation and may also provide an error message. An error message may be in code, stored in memory (sometimes in non-volatile memory) for retrieval by a service person. In some cases, an error message may manifest itself in a blinking light, with the blinking pattern providing an error code. The error message may simply be recognized by the water heater shutting down.

If the first sensor is present, control passes to decision block 116, where controller 46 (FIG. 2) determines whether the second sensor is present. If the second sensor is not present, control passes to decision block 118 where controller 46 determines if the second sensor is required. In some instances, the second sensor may be deemed to be required if an appropriate flag has been set. If the flag has not been set, the second sensor is not deemed to be required.

If, at decision block 118, controller 46 determines that sensor two is required, control passes once again to block 114, where burner operation is disabled and an error message may be provided. If, however, the second sensor is not required, control passes to block 124. At block 124, controller 46 (FIG. 2) processes any other control functions necessary for operation of the building equipment component before returning to block 110, where the method is repeated. It should be noted that this method is a continuous method, and may be repeated in accordance with any desired time frame. For example, the method may begin at block 110 every ten seconds, every five seconds, every one second, or any other desired interval.

Returning to decision block 116, if controller 46 (FIG. 2) determines that the second sensor is present, control passes to decision block 120. At decision block 120, controller 46 determines if the second sensor has been detected at least N times. N may be an integer set to any desired number. In some instances, N may be set equal to one, two, three, four, five or any desired integer.

If the second sensor has been detected at least N times, control passes to block 122, where controller 46 (FIG. 2) sets a second sensor "Required Flag" in non-volatile memory. If the second sensor has not been detected, or has been detected less than N times, control passes to block 124, where controller 46 processes other control functions.

In the illustrated embodiment, the second sensor "Required Flag" is used by controller 46 to determine, such as at decision block 118 if the second sensor is required. Therefore, if a second sensor has been included or added to a building equipment component such as a water heater for any of a variety of reasons after a period of time, the presence of the second sensor will be required for continued appliance operation. A second sensor may be included, for example, to provide additional safety and/or for improved performance.

It can be seen, moreover, that controller 46 (FIG. 2) may be adapted such that it may function in a situation in which the building equipment component being controlled by controller 46 has only one sensor. Controller 46 may be adapted such that it may function in a situation in which the building equipment component being controlled by controller 46 has both a first sensor and a second sensor.

The invention should not be considered limited to the particular examples described above, but rather should be understood to cover all aspects of the invention as set out in the attached claims. Various modifications, equivalent processes, as well as numerous structures to which the invention can be applicable will be readily apparent to those of skill in the art upon review of the instant specification.

What is claimed is:

1. A method of operating a building equipment component, the building equipment component including an element, the method comprising the steps of:

detecting if the element is present;

determining if the element is required;

operating the building equipment component in a first mode if the element is present and required;

operating the building equipment component in a second mode if the element is not required, the second mode is different than the first mode; and stopping the building equipment component if the element is absent and required.

2. The method of claim 1, wherein the element is determined to be required if detected at least once.

3. The method of claim 1, wherein the building equipment component comprises a required first sensor, and the element comprises an optional second sensor.

4. The method of claim 1, wherein operating the building equipment component comprises operating a heat source.

5. The method of claim 4, wherein stopping the building equipment component comprises stopping the heat source.

6. The method of claim 1, wherein the building equipment component has an operational cycle, and the step of determining if the element is present occurs each operational cycle.

7. The method of claim 6, wherein the building equipment component comprises a water heater, and the step of determining if the element is present occurs each time the water heater enters a heating period.

8. A method of operating a building equipment component, the building equipment component comprising a first sensor and a second sensor, the method comprising the steps of:

checking for a presence of the first sensor;

determining if the first sensor is required;

disabling operation of the building equipment component if the first sensor is not detected;

checking for a presence of the second sensor;

disabling operation of the building equipment component if the second sensor is required but not detected; and enabling operation of the building equipment component if the first sensor is detected and the second sensor is required and detected.

9. The method of claim 8, wherein the second sensor is deemed to be required if the second sensor is detected at least three times.

10. The method of claim 8, wherein the building equipment component comprises a heat source.

11. The method of claim 10, wherein the heat source comprises a fuel burner.

12. The method of claim 10, wherein the heat source comprises an electrical heating element.

13. A method of operating a water heater, the water heater including a first sensor and optionally including a second sensor, the method comprising the steps of:

detecting a presence of the first sensor;

detecting a presence or absence of the second sensor;

operating the water heater in a first mode if the first sensor is present and the second sensor is absent;

operating the water heater in a second mode if the first sensor and the second sensor are both present; and stopping the water heater if the second sensor is subsequently removed after being detected.

14. The method of claim 13, wherein stopping the water heater comprises stopping the water heater if the second sensor has been removed after a given period of time after detection of the second sensor.

15. The method of claim 13, wherein stopping the water heater comprises stopping the water heater if the second sensor has been removed after a given number of water heater cycles after initial detection of the second sensor.

16. The method of claim 13, wherein operating the water heater in a first mode comprises operating the water heater using sensor input from the first sensor.

17. The method of claim 13, wherein operating the water heater in a second mode comprises operating the water heater using sensor input from the first sensor and from the second sensor.

18. The method of claim 13, wherein the first sensor comprises a first temperature sensor.

19. The method of claim 13, wherein the second sensor comprises a second temperature sensor.

20. A controller for controlling a building equipment component, the building equipment component optionally including an element, the controller:

detecting if the element is present or absent;

operating the building equipment component in a first operating mode when the element is present;

operating the building equipment component in a second operating mode when the element is absent; and stopping the building equipment component if the element is subsequently detected as being absent after being detected as present.

21. The controller of claim 20, wherein the building equipment component comprises a water heater.

22. The controller of claim 21, wherein the water heater comprises a first water temperature sensor, and the element is a second water temperature sensor.

23. The controller of claim 22, comprising a first sensor input that may be connected to the first water temperature sensor, a second sensor input that may be connected to the second water temperature sensor, and a microcontroller configured to recognize signals received by the first sensor input and the second sensor input.

24. A water heater, comprising:

a water tank having a top and a bottom;

a first temperature sensor positioned proximate the bottom of the water tank;

a second temperature sensor positioned proximate the top of the water tank;

a heating element; and a controller for controlling the heating element, the controller including a first sensor input and a second sensor input;

wherein the controller permits operation of the heating element only when the first sensor input detects the first temperature sensor and the second sensor input detects the second temperature sensor.

25. The water heater of claim 24, wherein the controller does not permit operation of the heating element if the second sensor input does not detect the second temperature sensor.

* * * * *